US009874050B2

(12) United States Patent
Mair et al.

(10) Patent No.: US 9,874,050 B2
(45) Date of Patent: Jan. 23, 2018

(54) SLIDING DOOR MODULE/PIVOTING SLIDING DOOR MODULE HAVING FLOATING MOUNTING OF A RACK OF A RACK-AND-PINION DRIVE

(71) Applicant: KNORR-BREMSE GESELLSCHAFT MIT BESCHRÄNKTER HAFTUNG, Mödling (AT)

(72) Inventors: Andreas Mair, Oberschlierbach (AT); Heinz Zarl, Zeilem (AT); Andreas Schunke, Hardegsen (DE)

(73) Assignee: KNORR-BREMSE GESELLSCHAFT MIT BESCHRANKTER HAFTUNG (AT)

( * ) Notice: Subject to any disclaimer, the term of this patent is extended or adjusted under 35 U.S.C. 154(b) by 0 days.

(21) Appl. No.: 15/024,263

(22) PCT Filed: Sep. 19, 2014

(86) PCT No.: PCT/AT2014/050212
§ 371 (c)(1),
(2) Date: Mar. 23, 2016

(87) PCT Pub. No.: WO2015/039159
PCT Pub. Date: Mar. 26, 2015

(65) Prior Publication Data

US 2016/0237731 A1 Aug. 18, 2016

(30) Foreign Application Priority Data

Sep. 23, 2013 (AT) ..... A 50604/2013
Sep. 23, 2013 (AT) ..... A 50607/2013

(51) Int. Cl.
*E05F 11/34* (2006.01)
*E05F 15/00* (2015.01)
(Continued)

(52) U.S. Cl.
CPC ..... *E05F 15/00* (2013.01); *B61D 19/00* (2013.01); *B61D 19/005* (2013.01);
(Continued)

(58) Field of Classification Search
CPC .. E05F 15/00; E05D 15/0604; E05D 15/0652; B61D 19/005; B61D 19/00; E06B 3/4636; E06B 3/50
(Continued)

(56) References Cited

U.S. PATENT DOCUMENTS 3,854,418 A 12/1974 Bertin
5,351,441 A 10/1994 Hormann
(Continued)

FOREIGN PATENT DOCUMENTS

CN 101535584 A 9/2009
CN 101787827 A 7/2010
(Continued)

OTHER PUBLICATIONS

Austrian examination report dated Mar. 18, 2015.
(Continued)

*Primary Examiner* — Jerry Redman
(74) *Attorney, Agent, or Firm* — Barnes & Thornburg LLP

(57) ABSTRACT

A sliding door module or pivoting sliding door module for a rail vehicle includes a door leaf and a support, which is aligned longitudinally in the sliding direction of the door leaf and is mounted such that the support can be displaced in the horizontal direction in particular transversely to the longitudinal extent thereof. The sliding door module or pivoting sliding door module also has a linear guide for mounting the door leaf, which is fastened to or integrated in the support. The door leaves are moved with the aid of a rack-and-pinion drive. The rack-and-pinion drive has a rack
(Continued)

which is coupled only in the first end region thereof to the door leaf, and the floating end of which is engaged with a gearwheel that is mounted rotatably in the support.

16 Claims, 3 Drawing Sheets

(51) Int. Cl.
*B61D 19/00* (2006.01)
*E05D 15/06* (2006.01)
*E06B 3/46* (2006.01)
*E06B 3/50* (2006.01)

(52) U.S. Cl.
CPC ..... *E05D 15/0604* (2013.01); *E05D 15/0652* (2013.01); *E06B 3/4636* (2013.01); *E06B 3/50* (2013.01); *E05Y 2900/51* (2013.01)

(58) Field of Classification Search
USPC ..... 49/116, 118
See application file for complete search history.

(56) References Cited

U.S. PATENT DOCUMENTS

| | | | | |
|---|---|---|---|---|
| 5,483,769 | A * | 1/1996 | Zweili | B61D 19/008 49/118 |
| 6,119,402 | A * | 9/2000 | Wisner | E05F 11/535 49/118 |
| 7,971,391 | B2 * | 7/2011 | Harie | E05F 17/004 49/118 |
| 8,978,301 | B2 * | 3/2015 | Ueda | E05B 83/363 292/201 |
| 2004/0244295 | A1 * | 12/2004 | Derham | E05F 15/665 49/362 |
| 2010/0188177 | A1 * | 7/2010 | Inage | B61D 19/005 335/205 |
| 2014/0366449 | A1 * | 12/2014 | Masuda | B61D 19/007 49/281 |
| 2016/0215554 | A1 * | 7/2016 | Uno | B61D 19/02 |
| 2016/0229424 | A1 * | 8/2016 | Takayama | E05D 15/063 |

FOREIGN PATENT DOCUMENTS

| | | | | |
|---|---|---|---|---|
| DE | 2309949 | | 9/1973 | |
| DE | 3123554 | A1 | 12/1982 | |
| DE | G 9110995.7 | U1 | 2/1993 | |
| DE | 202009010695 | U1 | 1/2011 | |
| EP | 0558973 | A1 | 9/1993 | |
| EP | 1516984 | A2 | 3/2005 | |
| EP | 2287428 | A2 | 2/2011 | |
| FR | 2133309 | | 11/1972 | |
| JP | H0227509 | B2 | 6/1990 | |
| JP | H0941839 | A | 2/1997 | |
| JP | 2006316524 | A | 11/2006 | |
| JP | 2010111259 | A | 5/2010 | |
| WO | 9012184 | A1 | 10/1990 | |
| WO | 2008056620 | A1 | 5/2008 | |
| WO | WO 2008056620 | A1 * | 5/2008 | B61D 19/005 |

OTHER PUBLICATIONS

Search report for International Patent Application No. PCT/AT2014/050212; dated Feb. 18, 2016.
Japanese Office Action corresponding to 2016-516584, dated May 15, 2017.
Chinese Office Action corresponding to 201480058769.7, dated May 16, 2017.

* cited by examiner

SLIDING DOOR MODULE/PIVOTING SLIDING DOOR MODULE HAVING FLOATING MOUNTING OF A RACK OF A RACK-AND-PINION DRIVE

PRIORITY CLAIM

This patent application is a U.S. National Phase of International Patent Application No. PCT/AT2014/050212, filed 19 Sep. 2014, which claims priority to Austrian Patent Application No. A 50604/2013, filed 23 Sep. 2013 and Austrian Patent Application No. A 50607/2013, filed 23 Sep. 2013, the disclosures of which are incorporated herein by reference in their entirety.

FIELD

Illustrative embodiments relate to a sliding door module/pivoting sliding door module for a rail vehicle, comprising a door leaf, a support which is oriented longitudinally in the sliding direction of the door leaf and is mounted displaceably in the horizontal direction in particular transversely with respect to the longitudinal extent thereof, and a linear guide with a profiled rail and at least one guide carriage or guide slide mounted displaceably thereon. The profiled rail is fastened on the support or is included by the latter in the form of a profiled region. The door leaf is mounted displaceably with the aid of the at least one guide carriage/guide slide.

BACKGROUND

Sliding door modules/pivoting sliding door modules of the type mentioned are basically known. At least one door leaf or two door leaves is or are mounted displaceably and, for opening, are first of all deployed with the aid of a deployment mechanism and then displaced, in the case of a pivoting sliding door module, or are only displaced, in the case of a sliding door module. For the sliding movement, use is made, according to the prior art, of, for example, spindle drives, cable pulls and rack drives.

SUMMARY

Disclosed embodiments specify an improved sliding door module/pivoting sliding door module. In particular, the weight of a sliding door module/pivoting sliding door module with a rack-and-pinion drive is intended to be reduced without the reliability thereof being impaired as a result.

This is achieved with a sliding door module/pivoting sliding door module of the type mentioned at the beginning, which comprises a rack-and-pinion drive for the door leaf, which rack-and-pinion drive has a rack which is directly or indirectly connected only in the first end region thereof to the at least one guide carriage/guide slide or to the door leaf, and the floating end of which is in engagement with a gearwheel mounted rotatably in the support.

BRIEF DESCRIPTION OF FIGURES

Exemplary embodiments will be discussed in greater detail in the following text together with the figures, in which.

DETAILED DESCRIPTION

Figure 1:
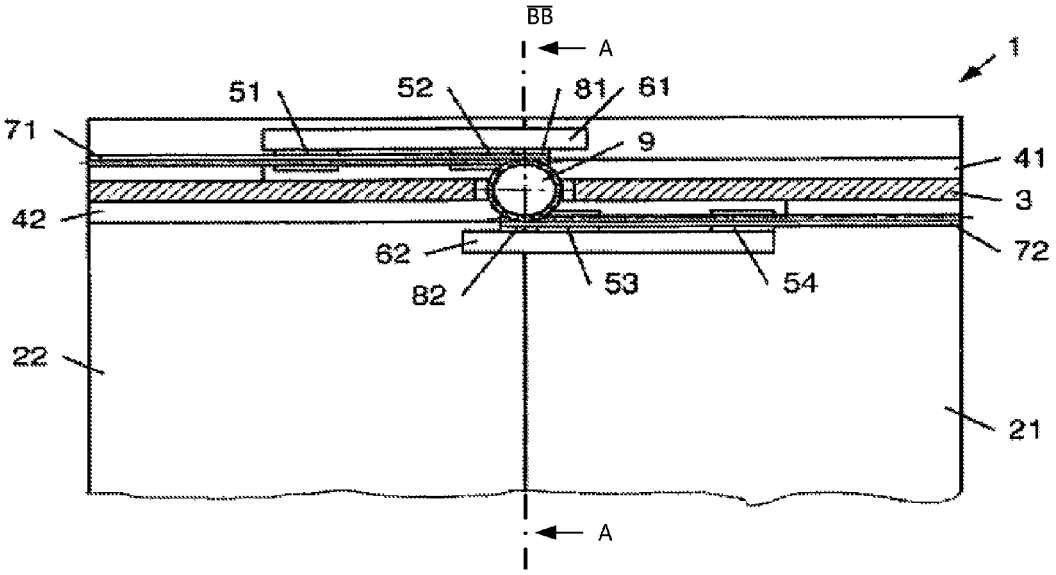
FIG. 1 shows a schematically illustrated and exemplary sliding door module/pivoting sliding door module for a rail vehicle in longitudinal section.

The proposed measures prevent distortion of the rack-and-pinion drive, even if the support, along which the guide carriages/guide slides move, is deformed because of the weight of the sliding door module/pivoting sliding door module or other loads. By means of the mounting on one side, the rack is namely decoupled from the support and therefore does not have to follow deformation of the latter. The rack-and-pinion drive therefore also remains smooth-running and is reliable even if a comparatively large deformation of the support is structurally permitted in favor of a reduced weight of the sliding door module/pivoting sliding door module.

The solution presented can be used both in the case of a linear rolling guide, in which a guide carriage is mounted on a profiled rail with the aid of rolling bodies, and also in the case of a linear slideway, in which a guide slide slides on the profiled rail. The rack-and-pinion drive can generally be spur-toothed or helically toothed.

It is possible if the first end region of the rack is fixed in position in relation to the at least one guide carriage/guide slide. As a result, the rack can be fastened with simple means, for example can be screwed on.

However, it is also possible if the first end region of the rack is mounted rotatably and/or displaceably in relation to the at least one guide carriage/guide slide.

In this manner, the rack can be decoupled even better from the support, and therefore the latter can be deformed to an even greater extent without the rack-and-pinion drive being impaired. For example, the first end region can be mounted with the aid of a rotatable pin. It is also conceivable for a (cylindrical) pin to be mounted in an elongated hole and thus for a rotatable and displaceable mounting to be realized. If only a displaceable mounting is desired, this can be realized, for example, with the aid of a sliding block guided in a groove or, for example, also by a dovetail connection.

It is possible that, if a first slideway or a rolling body for guiding the rack is arranged opposite the gearwheel. The rack is thereby prevented from lifting off from the gearwheel. For example, the first slideway can be formed by a plastics block (for example composed of Teflon) which is arranged opposite the gearwheel. The rack is then guided displaceably between the block and the gearwheel. The rolling body can be designed in particular as a (ball-mounted) roller.

It is also possible that, if the floating end of the rack is mounted in a second slideway. This prevents the floating end from exciting excessively severe vibrations during the operation of the rail vehicle and causing noise or even damage. For example, the second slideway can be formed by an element on the rack (for example sliding bolt, sliding block, etc.), which is guided displaceably in a groove.

It is also possible if the rack is mounted in a second slideway at a plurality of spaced-apart points. For example, these bearing points can be arranged at locations at which otherwise severe vibrations would form (vibration antinodes). Since the vibration behavior of the rack changes with the position relative to the gearwheel, the vibration behavior of the rack can also be analyzed within the scope of a computer simulation, as a result of which the bearing points can be positioned at a suitable location. In particular, the vibration behavior of the rack in the open position and in the closed position of the sliding door can be used for positioning the bearing points. It has proven particularly advantageous if the rack is mounted displaceably at three bearing points, in particular if the bearing points and the fastening point are spaced apart from each other at the same distance in the first end region.

It is possible if the gearwheel has a hardened surface or a harder material than the rack. The rack-and-pinion drive is particularly quiet as a result. Furthermore, rack and gearwheel wear approximately identically since an individual tooth flank of the rack is significantly more rarely in engagement with the gearwheel than vice versa because of the size ratios. That is to say a tooth flank of the gearwheel is subjected to greater stress than a tooth flank of the rack.

It is possible in this connection if the gearwheel is composed of metal and the rack is composed of plastic, in particular of polyamide PA12G. For example, the rack can be formed by an injection molded part. The use of polyamide PA12G results in particular in a long service life of the rack-and-pinion drive with only little operating noise.

However, it is also possible if the gearwheel is composed of metal and the rack has a metallic support, in particular composed of steel or aluminum, with a plastics toothing, in particular composed of polyamide PA12G, mounted thereon. As a result, at the same time as the abovementioned advantages, high stability of the rack is achieved. In addition, distortion of the rack, as occurs during the hardening process of racks made of steel, is also avoided. The use of polyamide PA12G and/or aluminum also makes it possible to improve the vibration behavior of the racks since the two materials are lightweight and have good damping behavior, and therefore vibrations are excited to only a small extent and rapidly fade away again. In addition, both materials are highly flexible, and therefore they cause only small bearing forces at the gearwheel in the event of deformation.

It is possible if the plastics toothing is fastened onto the metallic support with the aid of a latching connection. The rack can thereby be produced particularly rapidly since the toothing merely has to be clipped onto the support. For example, for this purpose, latching lugs on the plastics toothing are inserted into bores in the metallic support. Of course, other fastening techniques, for example adhesively bonding the plastics toothing onto the metallic support, are also conceivable. It is also possible for the plastics toothing to be connected directly during the production thereof to the metallic support, for example by the plastics toothing being sprayed or cast onto the support.

It is possible if the plastics toothing consists of a plurality of segments. The production of a rack of any length is thereby simplified since, for this purpose, any number of relatively short tooth segments are merely arranged in a row with one another. An injection mold for such a tooth segment can likewise be produced comparatively simply.

It is possible if the segments are connected to one another by a tongue and groove connection or by a dovetail connection. As a result, an undesirable displacement of the segments with respect to one another is avoided.

It is possible if the sliding door module/pivoting sliding door module is of double-leaf design, and the gearwheel is in engagement with two racks, each of which is provided for moving one door leaf each, wherein the racks are arranged opposite each other with a mutually facing toothing. The two door leaves can thereby be driven by just one gearwheel. A further advantage of this arrangement is that it can be used with only small adaptations (i.e. by omitting one of the racks) for a single-leaf sliding door module/pivoting sliding door module.

It is possible in the above connection if one rack with a downwardly facing toothing are arranged above the gearwheel and the other rack with an upwardly facing toothing are arranged below the gearwheel. A sliding door module/pivoting sliding door module with a comparatively small installation depth can thereby be realized. However, it is, of course, also conceivable for the axis of the gearwheel to be oriented vertically and, accordingly, for one rack to be arranged in front of the gearwheel and one therebehind. In general, the use of a crown gear or bevel gear instead of a cylindrical gear is also conceivable. In this case, the racks can be arranged above and below the gear, when the gear axis is oriented vertically, and in front of and behind the gear, when the gear axis is oriented horizontally.

Finally, it is also possible if the sliding door module/pivoting sliding door module comprises a crossmember which is fastened on the at least one guide carriage/guide slide and in which the door leaf is mounted rotatably and on which the rack is fastened. As a result, the door leaf can be adjusted in the inclination thereof and also used for rail vehicles having inclined sidewalls. Furthermore, the door leaf remains in the predetermined positions thereof even if the support on which the door leaves are mounted is distorted.

DETAILED DESCRIPTION OF DISCLOSED EMBODIMENTS

It may be stated at the outset that identical parts are provided with the same reference signs or same component designations in the variously described embodiments, wherein the disclosures contained throughout the description can be transferred analogously to identical parts with the same reference signs or identical component designations. The position details selected in the description, such as, for example, at the top, at the bottom, laterally, etc. also relate to the immediately described and illustrated Fig. and, in the event of a change in position, can be transferred analogously to the new position. Furthermore, individual features or combinations of features from the various exemplary embodiments shown and described may constitute solutions which are independent, inventive or are according to the disclosed embodiments per se.

Figure 2:
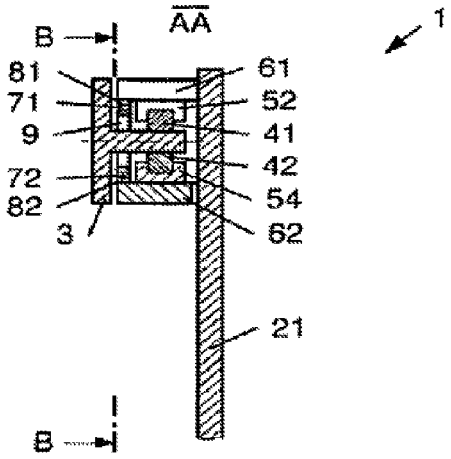
FIG. 2 shows the sliding door module/pivoting sliding door module from FIG. 1 in cross section.

FIGS. 1 and 2 show a schematically illustrated and exemplary sliding door module/pivoting sliding door module 1 for a rail vehicle, which comprises two door leaves 21, 22 and a support 3 which is oriented longitudinally in the sliding direction of the door leaf 21, 22 and which is mounted displaceably in the horizontal direction transversely with respect to the longitudinal extent thereof, in the case of a pivoting sliding door module, or is mounted fixedly, in the event of a sliding door module. Furthermore, the sliding door module/pivoting sliding door module 1 comprises two linear guides, each having a profiled rail 41, 42 and two guide carriages or guide slides 51 . . . 54 mounted displaceably thereon. The guide carriages/guide slides 51 and 52 are connected here to a first crossmember 61 to which the first door leaf 21 is fastened, for example via a bracket. The guide carriages/guide slides 53 and 54 are connected to a second crossmember 62 to which the second door leaf 22 is fastened, for example likewise via a bracket. The door leaves 21, 22 are therefore mounted displaceably with the aid of the guide carriages/guide slides 51 . . . 54. In addition, the door leaves 21, 22 could be mounted rotatably (about an axis of rotation oriented in the sliding direction of the door leaves 21, 22) in the crossmembers 61, 62 or in brackets fastened thereto.

In this example, the profiled rails 41, 42 are fastened on the support 3. Alternatively to a separate profiled rail 41, 42, the support 3 could also have a profiled region on which the guide carriage or guide slide 51 . . . 54 is mounted.

Furthermore, the sliding door module/pivoting sliding door module 1 has two rack-and-pinion drives for the door leaves 21, 22. The rack-and-pinion drives have a rack 71, 72 which is directly or indirectly connected only in the first end region thereof to one guide carriage/guide slide 51 . . . 54 each or to one door leaf 21, 22 each. Specifically, in the example shown, a rack 71 and 72 is fastened via one connecting plate 81, 82 each to one crossmember 61, 62 each. In specific terms, in this example, the first end region of each rack 71, 72 is therefore fixed in position in relation to one guide carriage/guide slide each. However, provision could also be made for the first end region of each rack 71, 72 to be mounted rotatably in relation to one guide carriage/guide slide 51 . . . 54 each (also see FIG. 5 in this regard). The floating end of the racks 71, 72 is in engagement with a gearwheel 9 mounted rotatably in the support 3.

Specifically, the sliding door module/pivoting sliding door module 1 illustrated is therefore of double-leaf design in this example, and the gearwheel 9 is in engagement with two racks 71, 72, each of which is provided for moving one door leaf 21, 22 each, and wherein the racks 71, 72 are arranged opposite each other with a mutually facing toothing. The rack 71, here with a downwardly facing toothing, is arranged above the gearwheel 9 and the rack 72 with an upwardly facing toothing is arranged below the gearwheel 9. It is thereby possible to drive the two door leaves 21, 22 with just one gearwheel 9. If the latter rotates in the clockwise direction, the sliding door is opened, and if the gearwheel rotates counterclockwise, the sliding door is closed. Another advantage of this arrangement is that it can be used with only small adaptations for a single-leaf sliding door module/pivoting sliding door module.

In general, the use of a crown gear or bevel gear instead of the cylindrical gear 9 illustrated in FIG. 1 is also conceivable. As a result, in the shown arrangement of the racks 71 and 72, the gear axis can be oriented vertically. If, by contrast, the gear axis of a crown gear or bevel gear is oriented horizontally, the racks 71 and 72 can be correspondingly arranged in front of and behind the gear.

Figure 3:
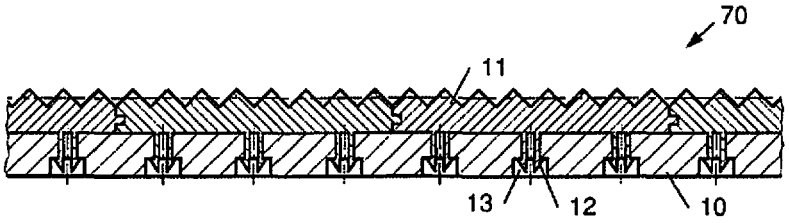
FIG. 3 shows an example of a rack with a metallic support and a plastics toothing mounted thereon.

In general, it is advantageous if the gearwheel 9 has a harder surface than the racks 71, 72. The noise emission of the rack-and-pinion drive can thereby be kept low. For example, the gearwheel 9 can be composed of metal and the racks 71, 72 can be composed of plastic. It is of particular advantage in this connection if the rack 70, as illustrated in FIG. 3, has a metallic support 10, in particular composed of steel or aluminum, with a plastics toothing 11, in particular composed of polyamide PA12G, mounted thereon. Distortion of the racks 71, 72, as generally occurs during the hardening process of racks made from steel, can thereby be avoided.

Specifically, the plastics toothing 11 is mounted on the metallic support 10 with the aid of latching lugs 12 which are inserted into bores 13 in the support 10. Of course, however, it would also be conceivable to screw or to rivet the plastics toothing 11 onto the support 10. In the latter case, it would be conceivable, for example, to provide cylindrical pins instead of the latching lugs 12, the ends of which pins are deformed, for example, by heating and/or pressure.

In this example, the plastics toothing 11 consists of a plurality of segments, but this does not absolutely have to be the case. Furthermore, the segments are connected to one another by an optional tongue and groove connection in order to avoid displacement of the segments in relation to one another. Alternatively, the segments could also be connected by a dovetail connection or else could simply butt against one another.

In a further embodiment, the plastics toothing 11 is adhesively bonded (butted) onto the support 10. It is also possible for the plastics toothing 11 to be sprayed or cast onto the support 10.

Figure 4:
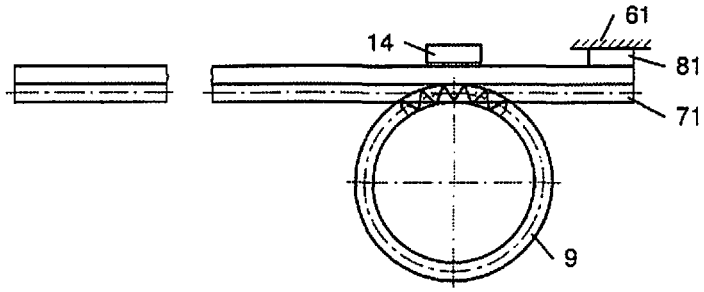
FIG. 4 shows an example of a rack-and-pinion drive with a first slideway opposite the driving gear.

FIG. 4 shows an example of a rack-and-pinion drive, in which a first slideway 14 for the rack 71 is arranged opposite the gearwheel 9. For example, the slideway 14 can be formed by a plastics part over which the rack 71 slips. The rack 71 is thereby prevented from lifting off from the gearwheel 9. For the sake of simplicity, only the rack-and-pinion drive in isolation from the rest of a sliding door module/pivoting sliding door module is illustrated in FIG. 4. Instead of the slideway 14, a rolling body for guiding the rack 71 can also be provided in FIG. 4. For example, the rolling body can be formed by a (ball-mounted) roller.

Figure 5:
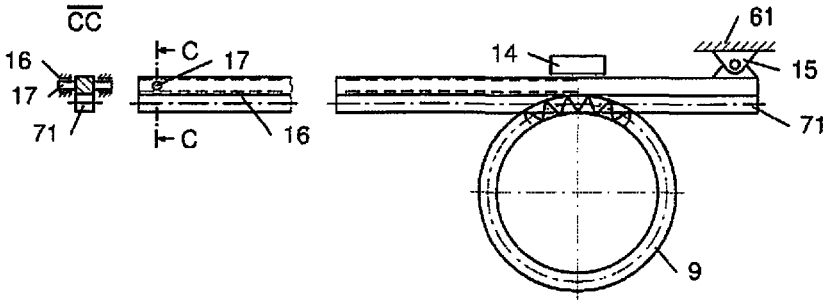
FIG. 5 shows an example of a rack-and-pinion drive with an articulated suspension of the rack which is additionally guided displaceably at the floating end thereof.

FIG. 5 shows a further example of a rack-and-pinion drive which is similar to the rack-and-pinion drive illustrated in FIG. 4. However, in contrast thereto, the rack 71 is not fixedly connected via a connecting plate 81 to the crossmember, but rather to a rotary bearing 15. In this manner, deformation of the support 3, which results in particular due to the weight of the door leaves 21, 22, can be compensated for. In this case, the rotary bearing 15 has a rotary bolt. However, it would also be conceivable for the rack 71 to be mounted in the crossmember 61 with the aid of a ball head.

In order further to improve the guidance of the rack 71, the floating end thereof can be mounted in a second slideway which, in this example, comprises a groove 16 and a bolt 17 which is mounted displaceably therein and is connected to the rack 71. The groove 16 is, for example, incorporated in the support 3, but may, for example, also be formed by a rail mounted on the support 3, in particular by a U profile.

Figure 6:
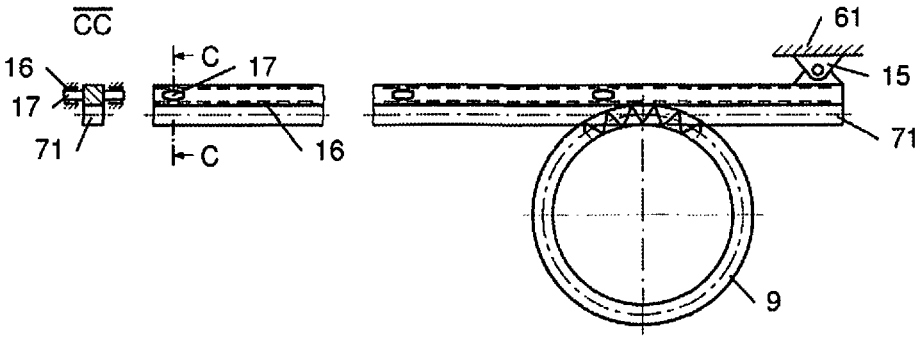
FIG. 6 shows an example of a rack-and-pinion drive with an articulated suspension of the rack which is additionally guided displaceably at a plurality of points.

FIG. 6 finally shows an example of a rack-and-pinion drive which is similar to the rack-and-pinion drive illustrated in FIG. 5. However, in contrast thereto, the rack 71 is not only mounted at the floating end thereof in a displaceable manner in a groove 16, but rather at a plurality of points. In addition, the sliding bodies are not bolts, but rather sliding blocks 17 having curved sliding surfaces.

For example, the sliding blocks 17 can be arranged at locations at which otherwise strong vibrations would form (vibration antinodes). Since the vibration behavior of the rack 71 changes with the position relative to the gearwheel 9, the vibration behavior of the rack 71 can be analyzed within the scope of a computer simulation, as a result of which the sliding blocks 17 can be positioned at a suitable location. In a simplified manner, it is also possible merely for the vibration behavior of the rack 71 in the open position and in the closed position of the sliding door to be used for positioning the sliding blocks 17. It is advantageous in particular if three sliding blocks 17 (or else other guides, such as, for example, sliding bolts) are each distributed at a distance of approximately ⅓ from the floating end beginning on the rack 71, wherein L indicates the length of the rack 71. Given a suitable positioning of the sliding blocks 17, it is possible, under some circumstances, to omit a first slideway 14 because of the only slight lifting off of the rack 71 from the gearwheel 9, as is illustrated in FIG. 6.

Figure 7:
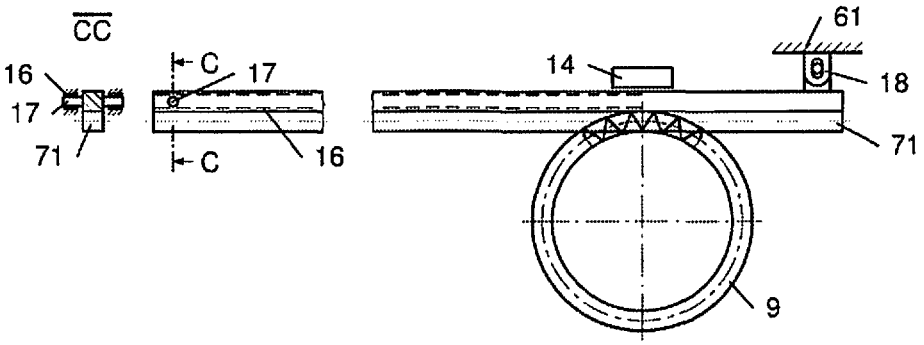
FIG. 7 is as per FIG. 5, but with a displaceable suspension of the rack.

FIG. 7 shows a further example of the suspension of a rack 71, which suspension is very similar to the suspension shown in FIG. 5. However, in this example, a combined rotary and sliding bearing 18 is provided instead of the rotary bearing 15. Specifically, this is realized by the fact that a (cylindrical) bolt is mounted in an elongated hole and therefore permits a sliding movement and a rotational movement of the rack 71 in relation to the crossmember 61. As a result, for example, manufacturing-induced and/or temperature-induced tolerances can be compensated for even better.

It would also be conceivable to design the bearing 18 only as a sliding bearing, that is to say to permit only a displacement movement of the rack 71 in relation to the crossmember 61, but not a rotational movement. This can be realized structurally, for example, by, instead of a bolt, a pin with a rectangular cross section being mounted displaceably (but non-rotatably) in the elongated hole. The use of a different linear guide, for example a dovetail guide, is likewise also conceivable.

In FIG. 7, only the first (here the right) end of the rack 71 is provided with a rotary and sliding bearing 18. However, it is also conceivable for the floating end to be provided with such a rotary and sliding bearing 18 and thus replaces the sliding bolt/sliding block 17 (see FIG. 5). This embodiment is not only limited to the floating end of the rack 71, but also rotary and sliding bearings 18 can be used at a plurality of points (also see FIG. 6). The bearing 18 can also be designed here only as a sliding bearing.

In the case of the embodiments in the previous paragraph, a sliding bolt/sliding block 17, which is guided in a groove 16, can be provided, for example, at the upper end of the rotary and/or sliding bearing 18. The sliding bolt/sliding block 17 then permits the displacement of the rack 71 in the horizontal direction, and the rotary and/or sliding bearing 18 permits a displacement of same in the vertical direction and optionally also the rotation thereof. However, it would also be conceivable simply to design the groove 16 in FIGS. 5 and 6 to be of an appropriate width such that the sliding block/sliding block 17 has a corresponding vertical clearance.

In order to avoid the rack 71 wobbling around freely, damping elements (for example composed of an elastomer) can also be used. For example, a groove 17 (which is too wide per se) can be lined with an elastomer, and therefore, although a vertical movement of the rack 71 is permitted, there is nevertheless a certain resistance thereto. For this purpose, for example, the inside of the elongated hole of the rotary and sliding bearing 18 can also be lined with a damping material.

In general, a rack 71, 72 composed of polyamide PA12G, or a composite rack 71, 72 (see FIG. 3) with a support 10 composed of aluminum and a toothing 11 composed of polyamide PA12G, has proven advantageous in respect of the vibration behavior of the rack 71, 72. Both polyamide PA12G and aluminum are lightweight and have good damping behavior, and therefore vibrations are excited to only a small extent and rapidly fade away again. In addition, both materials are highly flexible, and therefore they can easily follow a deformation of the support 3 and do not cause any excessively large bearing forces at the gearwheel 9.

Further possible combinations of materials can be gathered from the tables below:

| Rack<br>Gearwheel | C45<br>Zinc-coated | C45<br>zinc-coated<br>yellow chromating | C45<br>CDC anti-friction paint | C45<br>Duralloy | C45<br>carbonitrided | Aluminum<br>Hard anodized |
|---|---|---|---|---|---|---|
| POM | X | X | X | X | | X |
| POM + PE | X | X | X | X | | X |
| PA66 | X | X | X | X | | X |
| PA6-OIL | X | X | X | X | | X |
| PA12G | X | X | X | X | | X |
| PA10T/X (PPA/Grivory XE 4053 | X | X | X | X | | X |
| PA66 + CF | X | X | X | X | | X |
| PA66 + AF | X | X | X | X | | X |
| C45 carbonitrided | | | | | X | |

| Gearwheel<br>Rack | C45 zinc-coated | C45<br>Duralloy | Aluminum<br>Hard-anodized |
|---|---|---|---|
| C45 zinc-coated | | X | |
| C45 zinc-coated, yellow-chromated | | X | |
| POM | X | X | X |
| POM + PE | X | X | X |
| PA66 | X | X | X |
| PA6 + PTFE | X | X | X |
| PA66 + MoS2 | X | X | X |
| PA12G | X | X | X |
| PA10T/X (PPA/Grivory XE 4053) | X | X | X |

Key: C45 (steel with a 0.45% portion of carbon), yellow chromating (application of a yellow chromium coating), Duralloy (thin chromium coating), CDC (cathodic dip coating), carbonitriding (special hardening process), hard-anodizing (application of particularly resistant oxide layers), POM (polyoxymethylene), PE (polyethylene), PTFE (polytetrafluoroethylene), PAx (polyimide), MoS2 (molybdenum-disulfide), PPA (polyphthalamide). The plastics mentioned may be alternated with filling material, in particular with fibers. Specifically, carbon fibers (CF), aramid fibers (AF) and glass fibers (GF) are suitable for this purpose. The composite materials PA66+CF and PA66+AF have proven particularly advantageous in this connection.

In the case of the sliding door module/pivoting sliding door module 1 illustrated in FIGS. 1 and 2, the guide carriages/guide slides 51 . . . 53 can generally be connected rigidly or in an articulated manner to the crossmember 61, 62. If they are connected in an articulated manner, a rotary bearing 15 may be spared under some circumstances since the rack 71, 72 is very easily decoupled from the support 3 even without a rotary bearing 15 because of the articulated suspension of the crossmember 61, 62.

The exemplary embodiments show possible variant embodiments of a sliding door module/pivoting sliding door module 1 according to the disclosed embodiments, wherein it may be mentioned at this juncture that the disclosed embodiments is not restricted to the specifically illustrated variant embodiments thereof; rather, various combinations of the individual variant embodiments are also possible, and this variation option, on account of the teaching relating to the technical practice provided by the present disclosed embodiments, falls within the area of expertise of a person skilled in this technical art. The scope of protection therefore covers all conceivable variant embodiments which are made possible by combining individual details of the variant embodiment which has been illustrated and described.

In particular, it is stated that a sliding door module/pivoting sliding door module 1 may in reality also comprise more or fewer constituent parts than illustrated.

As a matter of form, it may be pointed out in conclusion that, to give a better understanding of the construction of the sliding door module/pivoting sliding door module 1, the latter, or the constituent parts thereof, in some cases have not been illustrated to scale and/or have been illustrated on an enlarged and/or reduced scale.

The object on which the independent solutions of the disclosed embodiments are based can be gathered from the description.

EP 2 287 428 A2 discloses, for example, a pivoting sliding door module with a rack-and-pinion drive, in which the rack is fastened rigidly on a support. The relatively exacting tolerances of a rack-and-pinion drive necessitate a comparatively stiff substructure. That is to say in particular the support on which the racks are mounted may be deformed as little as possible, in order to avoid jamming of the gearing. The constructions used according to the prior art are therefore designed to be comparatively rigid and are accordingly heavy, which also has a negative effect on the overall weight of the rail vehicle. In particular in urban traffic, in which the rail vehicles are accelerated and braked again at short intervals, such a supporting construction reduces the energy efficiency of the rail vehicle.

LIST OF REFERENCE SIGNS

1 Sliding door module/pivoting sliding door module
21, 22 Door leaf
3 Support
41, 42 Profiled rail/profiled region
51 . . . 53 Guide carriage/guide slide
61, 62 Crossmember
71, 72 Rack
81, 82 Connecting plate
9 Gearwheel
10 Metallic support
11 Plastics toothing
12 Latching lug
13 Bore
14 First slideway
15 Rotary bearing
16 Sliding groove of the second slideway
17 Sliding bolt/sliding block of the second slideway
18 Combined rotary and sliding bearing

The invention claimed is:

1. A sliding door module, the module comprising:
a door leaf;
a support oriented longitudinally in a sliding direction of the door leaf and is mounted displaceably in a horizontal direction; and
a linear guide with a profiled rail and at least one guide slide mounted displaceably on the profiled rail;
wherein the profiled rail is fastened on the support or is included by the support as of a profiled region;
wherein the door leaf is mounted displaceably via the at least one guide slide;
wherein the module further comprises a rack-and-pinion drive-having a rack which is connected only in a first end region thereof to the at least one guide slide, or to the door leaf, and
a floating end of the rack is in engagement with a gearwheel mounted rotatably to the support,
wherein the first end region of the rack is mounted rotatably or displaceably relative to the at least one guide slide.

2. A sliding door module, the module comprising:
a door leaf;
a support oriented longitudinally in a sliding direction of the door leaf and is mounted displaceably in a horizontal direction; and
a linear guide with a profiled rail and at least one guide slide mounted displaceably on the profiled rail;
wherein the profiled rail is fastened on the support or is included by the support as of a profiled region;
wherein the door leaf is mounted displaceably via the at least one guide slide;
wherein the module further comprises a rack-and-pinion drive, having a rack which is connected only in a first end region thereof to the at least one guide slide, or to the door leaf, and
a floating end of the rack is in engagement with a gearwheel mounted rotatably to the support,
wherein the first end region of the rack is fixed in a position in relation to the at least one guide slide, and
further comprising a first slideway for guiding the rack arranged on a vertical axis opposite the gearwheel.

3. The module of claim 1, further comprising a first slideway for guiding the rack and being arranged opposite the gearwheel.

4. The module of claim 1, wherein the floating end of the rack is mounted in a second slideway.

5. The module of claim 1, wherein the rack is mounted in a second slideway at a plurality of spaced-apart points.

6. The module of claim 1, further comprising the gearwheel has a harder surface or a harder material than the rack.

7. The module of claim 1, wherein the gearwheel is composed of metal and the rack is composed of polyamide.

8. The module of claim 1, wherein the gearwheel is composed of metal and the rack has a metallic support composed of steel or aluminum, with a plastics toothing composed of polyamide, mounted thereon.

9. The module of claim 8, wherein the plastics toothing is fastened on the metallic support with a latching connection.

10. The module of claim 8, wherein the plastics toothing consists of a plurality of segments.

11. The module of claim 10, wherein the segments are connected to one another by a tongue and groove connection or by a dovetail connection.

12. The module of claim 8, wherein the plastics toothing is adhesively bonded onto the metallic support.

13. The module of claim 8, wherein the plastics toothing is sprayed or cast onto the metallic support.

14. The module of claim 1, wherein the module is of a double-leaf design, and the gearwheel is in engagement with two racks, each of which is provided for moving one door leaf each, wherein the racks are arranged opposite each other with a mutually facing toothing.

15. The module of claim 14, wherein one rack with a downwardly facing toothing is arranged above the gearwheel and a second rack with an upwardly facing toothing is arranged below the gearwheel.

16. The module of claim 1, wherein a crossmember is fastened on the at least one guide slide and the door leaf is rotatably mounted and on which the rack is fastened.

* * * * *